United States Patent [19]

Uuskallio

[11] Patent Number: 5,007,573

[45] Date of Patent: Apr. 16, 1991

[54] STAPLE GUN SUPPORT ASSEMBLY

[75] Inventor: Arvo F. Uuskallio, Hartland, Wis.

[73] Assignee: Briggs & Stratton Corporation, Wauwatosa, Wis.

[21] Appl. No.: 439,613

[22] Filed: Nov. 20, 1989 (Under 37 CFR 1.47)

[51] Int. Cl.[5] ..... B25C 5/02

[52] U.S. Cl. ..... 227/139; 227/148

[58] Field of Search ..... 227/148, 139

[56] References Cited

U.S. PATENT DOCUMENTS

| | | | |
|---|---|---|---|
| 2,101,660 | 12/1937 | Vogel . | |
| 2,752,596 | 7/1956 | McMullen . | |
| 4,144,628 | 3/1979 | Schick | 227/139 X |
| 4,197,974 | 4/1980 | Morton et al. | 227/8 |
| 4,424,929 | 1/1984 | Weis . | |
| 4,485,952 | 12/1984 | Weis . | |
| 4,540,112 | 10/1985 | Ewing . | |
| 4,821,937 | 4/1989 | Rafferty | 227/8 |

OTHER PUBLICATIONS

Operation and Maintenance Manual, distributed by Bostich Company, 1986.

*Primary Examiner*—Timothy V. Eley

*Attorney, Agent, or Firm*—Andrus, Sceales, Starke & Sawall

[57] ABSTRACT

A bracket support assembly connected to the lower end of the head of a staple gun. The support assembly includes a U-shaped plate member having a web portion that functions to longitudinally align the driveway of the gun with a fastener-receiving opening in the mounting bracket and a pair of opposite spaced apart leg portions which function to laterally align the driveway with respect to the fastener-receiving openings of the mounting bracket. A flat support plate extending across the lower end of the U-shaped plate member acts to support the mounting bracket during a fastener driving operation.

5 Claims, 2 Drawing Sheets

STAPLE GUN SUPPORT ASSEMBLY

BACKGROUND OF THE INVENTION

The present invention relates to tools for applying fasteners to a mounting bracket, and more particularly to an arrangement for supporting the bracket as well as longitudinally and laterally aligning the bracket and tool during a fastener driving operation.

The speed of small internal combustion engines employed with lawn and garden equipment, such as lawn mowers, is typically controlled by a remote speed control cable having one end connected to a remote speed control lever movable by an operator and its other end connected to a speed control lever on the engine. Such remote control cables generally employ a control wire slidably contained in a surrounding casing. The casing may be metal, plastic and/or combinations thereof depending upon the particular application.

In the past, various types of cable clamps have been employed for attaching the remote speed control cable to an engine component. One such clamp includes a clip member removably attachable to the cable casing having a body extending substantially perpendicular to the longitudinal axis of the cable. The clip member is substantially U-shaped with each side of the U having a bifurcated end defining a pair of legs having aligned cable-receiving openings dimensioned to tightly engage the casing of the cable. Each cable-receiving opening has a constricted middle section forming a throat and is similar in shape to an hour glass.

Such clips may be employed with a mounting bracket projecting from an engine component which includes an upstanding support member about which opposite sides of the U-shaped clip member are disposed. The clip member is prevented from moving axially on the mounting bracket by the bracket itself and a pair of vertically spaced apart projecting bosses on the outer end of the upstanding bracket member prevent lateral and/or rotational movement of the clip member.

In order to assemble the clip member on the mounting bracket, a tool such as a hammer is typically employed in such a manner that after the cable is properly manually positioned the clip member is struck with the hammer to drive the clip member onto the mounting bracket. Such a manual process is relatively slow and may result in injuries to a user's fingers and/or hand due to the need to physically hold the clip member in position while striking it with the hammer. It is therefore desirable to automate the assembly process and provide a power operated tool that could easily be properly located with respect to the bracket in order to quickly and accurately apply a fastener about the bracket.

SUMMARY OF THE INVENTION

A tool for applying a fastener to a mounting bracket which forms a cable clamp for fixedly mounting on a component of an internal combustion engine the casing of one end of a remote speed control cable that controls the speed of the engine. The clamp includes the fastener or clip member which is removably attachable to the cable casing and has a body extending substantially perpendicular to the longitudinal axis of the cable, and a mounting bracket on the engine for receiving and removably mounting the clip member thereon.

The body of the clip member is U-shaped with each side of the U having a bifurcated end defining a pair of legs having aligned cable-receiving openings dimensioned to tightly engage the casing of the cable. Each cable-receiving opening is in the shape of an hour glass.

The mounting bracket projects from an engine component and includes a pair of horizontally extending and vertically spaced apart ears having aligned fastener-receiving openings for therein. The fastener-receiving openings are dimensioned to snugly receive the fastener or clip member and provide abutment surfaces for preventing axial, lateral, and rotational movement of the fastener, yet permit ready removal of the fastener for servicing and/or replacement of the fastener itself or the cable.

The present invention provides an assembly for properly positioning the tool with respect to the mounting bracket and for supporting the mounting bracket during a fastener driving operation. The positioning means includes longitudinal alignment means for longitudinally aligning a fastener driveway of the tool relative to the fastener-receiving openings in the mounting bracket, and lateral alignment means for laterally aligning the driveway relative to the fastener recieving openings in the mounting bracket. Preferably, the positioning means comprises a U-shaped plate member having a web portion and a pair of opposite spaced apart leg portion defining a bracket receiving opening therebetween for snuggly receiving the mounting bracket therein. The support means comprises a flat plate member connected to the U-shaped plate member extending across the lower end thereof to abut against the lower ear of the mounting bracket to support the lower ear during a fastener driving operation.

BRIEF DESCRIPTION OF THE DRAWINGS

The drawings illustrate the best mode presently contemplated of carrying out the invention.

In the drawings.

DESCRIPTION OF THE PREFERRED EMBODIMENT

Figure 1:
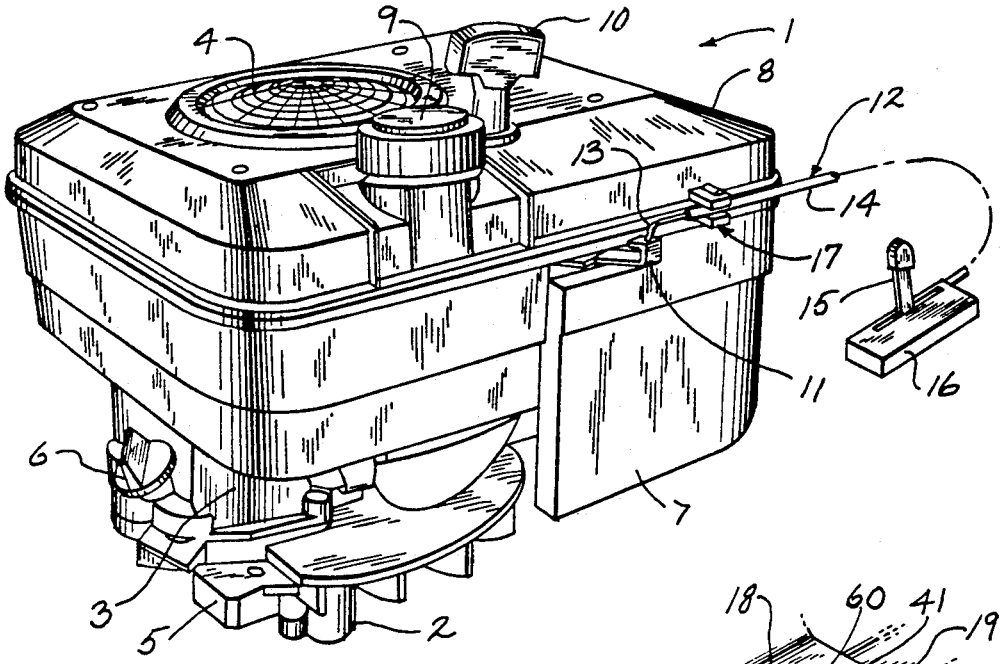
FIG. 1 is a perspective view of an internal combustion engine incorporating a cable clamp assembled in accordance with the present invention.

Referring to the drawings, FIG. 1 illustrates a small interal combustion engine, generally designated by the numeral 1, for use in connection with lawn and garden equipment, such as lawn mowers. Engine 1 is of the vertical shaft type and includes a crankshaft 2 connected to a piston (not shown) within cylinder 3, and a rotating air filtering screen 4. Oil for cylinder 3 is contained within oil sump 5 which may be filled via a fuel fill cap 9, and an optional handle 10 connected to a vertical pull starter rope (not shown). Fuel tank 8 is composed of a plastic material which reduces the overall weight of engine 1. Engine 1 also includes a speed control lever 11 which is pivotally mounted on engine 1 having one end projecting from engine 1 between air cleaner 7 and fuel tank 8, and its other end operatively connected to the carburetor of engine 1 for controlling the speed of engine 1.

A remote speed control cable 12 is typically used with lawn and garden equipment such as lawn mowers to control the speed of engine 1 by pivoting or moving engine speed control lever 11. Cable 12 defines a longitudinal axis and includes a metal control wire 13 slidably mounted within a surrounding plastic casing or jacket 14. As shown best in FIG. 1, one end i.e. the upper end of control wire 13 is connected to a remote speed control lever 15, which is pivotally mounted within a speed control box 16. Speed control box 16 is typically mounted on the handle assembly of a lawn mower for manual movement of lever 15 by an operator. The other end or lower end of the control wire 13 is connected to the projecting end of engine speed control lever 11. Cable casing 14, in turn, has its upper end connected to control box 16 and its lower end fixedly mounted on engine 1 by casing clamp 17. Thus, movement of control wire 13 by an operator pivoting remote speed control lever 15 results in movement of engine speed control lever 11 which, in turn, controls the speed of engine 1.

Figure 2:
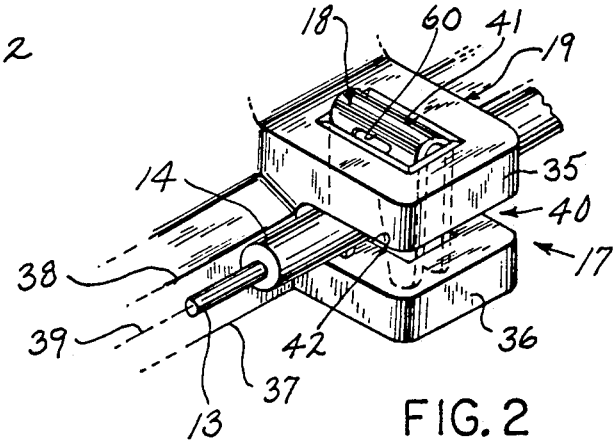
FIG. 2 is a fragmentary enlarged perspective view illustrating the components of the cable clamp of FIG. 1.
Figure 4:
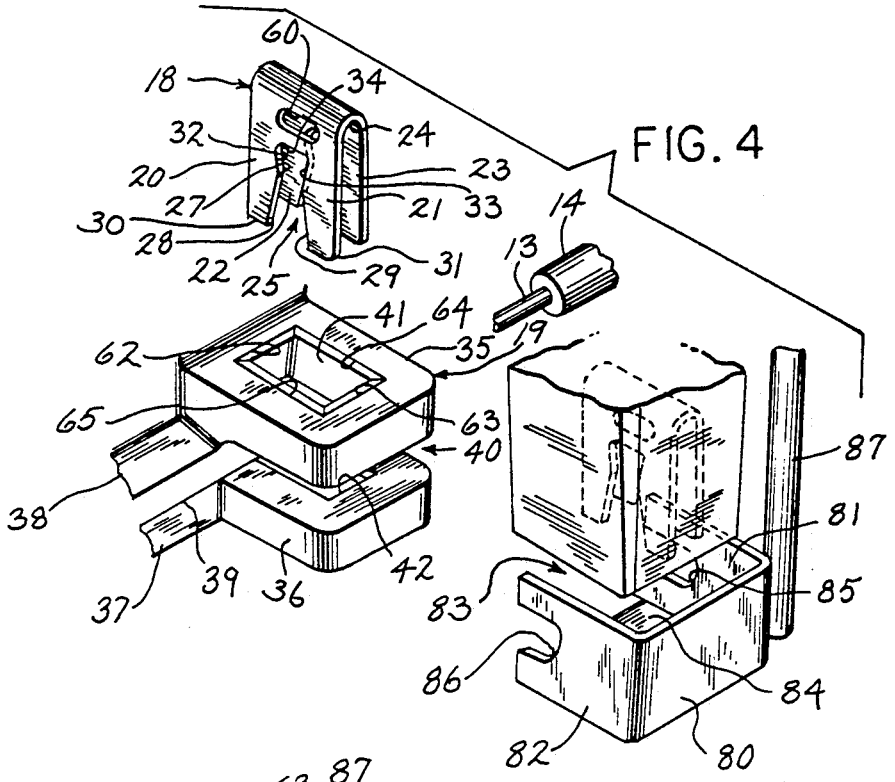
FIG. 4 is an exploded perspective view illustrating the components of the cable clamp and support assembly of the FIGS. 2 and 3.
Figure 5:
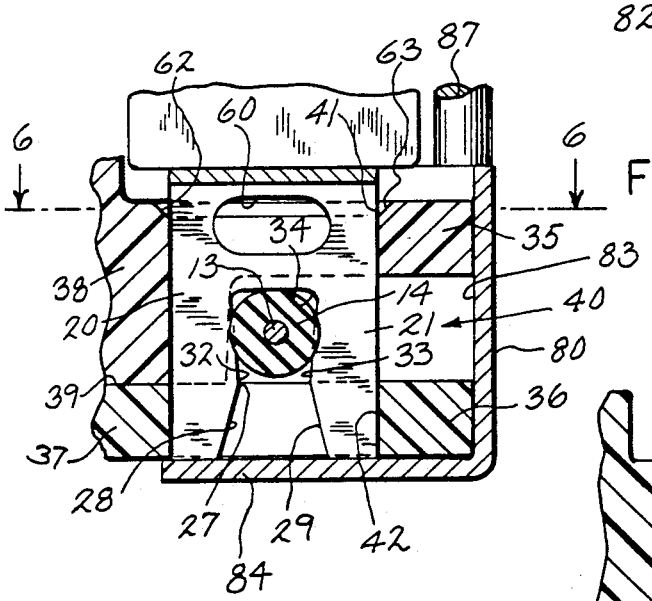
FIG. 5 is a fragmentary enlarged cross sectional view in elevation of the support assembly.

Turning now to FIGS. 2, 4 and 5, there is illustrated in more detail the components of casing clamp 17. Casing clamp 17 includes a metal clip member 18 removably attachable to casing 14 and a plastic mounting bracket 19 integrally formed on the side of plastic fuel tank 8 on engine 1 for receiving and removably mounting clip member 18 thereon. Clip member 18 comprises an elongated, relatively flat U-shaped body with each side of the U-shaped body terminating in a bifurcated end. Each bifurcated end of each side of the U-shaped body thus forms a pair of spaced apart legs 20, 21 and 22, 23 (FIG. 4), respectively. The upper or head end of the sides of the U-shaped body are integrally interconnected to form the web portion thereof and define an elongated slot 24 extending between the substantially parallel sides of the U-shaped body of clip member 18. The upper or head end of each of the sides of the U-shaped body also includes an oblong tool-receiving opening 60, respectively, formed therethrough. As shown best in FIG. 2, openings 60 are positioned such that when clip member 18 is inserted within bracket 19 a portion thereof is disposed above bracket 19 such that the tip of a screwdriver or other suitable tool may be inserted therein to remove clip member 18 from bracket 19 for servicing and/or replacement if necessary.

In FIG. 4, legs 20, 21 and legs 22, 23 each define aligned cable-receiving openings 25 therebetween, dimensioned to tightly engage casing 14 of control cable 12. Both openings 25 are identical in shape and therefore, only one opening will be described hereinafter. Opening 25 includes a constricted middle section forming a throat 27, a first or lower end section having opposite edges 28, 29 diverging from throat 27 to the toes 30, 31 of legs 20, 21 of clip member 18, and a second or upper end section having opposite edges 32, 33 extending in a direction opposite to edges 28, 29 and diverging from throat 27 to an upper edge 34, which is located between throat 27 and the head end of clip member 18.

As shown best in FIG. 5, the angle of divergence formed by edges 32, 33 is less than the angle of divergence formed by edges 28, 29. Preferably the angle of divergence of edges 32, 33 is about 4° and the angle of divergence of the edges 28, 29 is about 20°. The distance between throat 27 and upper edge 34 is at least equal to one-half the diameter of remote control cable 12 and preferably, as shown best in FIG. 4, is slightly greater than the diameter of cable 12. Additionally, as shown best in FIG. 5, the distance between opposite edges of throat 27 is less than the diameter of cable casing 14, but greater than the diameter of control wire 13. The above dimensions insure that edges 32, 33 "bite" into and tightly engage casing 14 of cable 12. Typically, the outer diameter of cable 12 varies from a minimum of about 0.185 inches to a maximum of about 0.230 inches. Additionally, the location of throat 27 with respect to upper edge 34 insures an "over-center" type positioning of cable 12 within opening 25, as best shown in FIG. 5, which thus prevents clip member 18 from backing off of cable 12 once cable 12 is positioned between edges 32, 33.

In FIG. 5, mounting bracket 19 includes a pair of horizontally extending and vertically spaced apart support ears 35, 36 integrally projecting from the side of fuel tank 8 in a cantilevered fashion. The inner end of each ear 35, 36 is composed of the identical plastic material as fuel tank 8, so as to permit molding of both fuel tank 8 and ears 35, 36 at the same time. It should be noted that fuel tank 8 is comprised of a base 37 and cover 38 sealed along a parting line 39. Thus, ear 35 may be integrally molded with cover 38 and ear 36 may be integrally molded with base 37, so that when assembled ears 35, 36 are vertically spaced apart from one another, as shown best in FIGS. 4–5, to define a cable-receiving slot 40 therebetween. As shown best in FIG. 5, the distance between ears 35, 36 and thus the width of slot 40, is slightly greater than the diameter of cable 12.

Ear 35 includes a clip receiving opening or slot 41 vertically aligned with a clip receiving opening or slot 42 in ear 36. Slots 41, 42 are dimensioned substantially corresponding to the outer dimensions of clip member 18 so as to snugly receive clip member 18 to prevent axial, lateral and rotational movement thereof. As a result, clip member 18 is immobilized after insertion into slots 41, 42. The upper edges of slot 41 include chamfered surfaces 62, 63, 64 and 65, respectively, which are tapered downwardly into slot 41. Chamfered surfaces 62–65 provide sufficient accessibility to opening 60 in clip member 18 and to the upper end of slot 24 to permit easy insertion of the tip of a screwdriver or other tool to remove clip member 18 from bracket 19 if necessary.

In order to fixedly mount casing 14 of cable 12 on engine 1, control wire 13 is first inserted into a hole in the projecting end of engine speed control lever 11, with engine speed control lever 11 and remote speed control lever 13 adjustably positioned for proper operation. Control cable 12 is then positioned within cable receivng slot 40 between ears 35, 36. Thereafter, a tool such as a staple gun hereinafter to be described may be utilized to drive clip member 18 downwardly through slots 41, 42, until cable 12 is positioned between edges 32, 33, as shown in FIGS. 2 and 5, with the upper end of clip member 18 slightly above the upper surface of ear 35 to hold cable 12. As shown best in FIG. 2, clip member 18 extends substantially perpendicular to the longitudinal axis of cable 12. In order to disassemble clip member 18 from bracket 19, a tool such as a screwdriver may be inserted along either chamfered surface 62 or 63 into openings 60, and the screwdriver is then used as a lever to pry clip member 18 upwardly off of cable 12.

Figure 3:
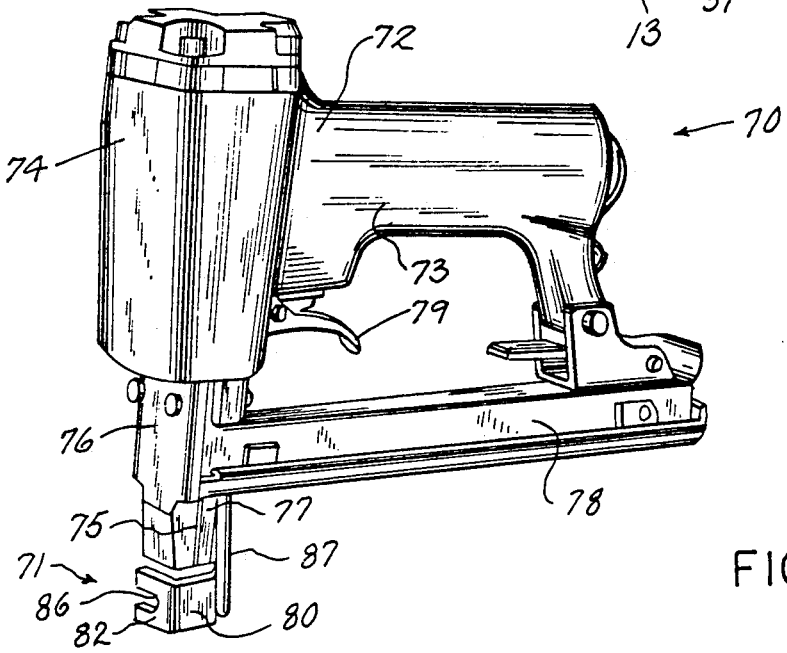
FIG. 3 is a perspective view of a staple gun incorporating a support assembly constructed in accordance with the principles of the present invention.

Referring now to FIG. 3, a tool, generally desinated by the numeral 70 is illustrated for driving clip member 18 into ears 35, 36. Tool 70 is a conventional pneumatic staple gun available from the Bostich Company under Model TU20 which has been modified to incorporate a support assembly generally designated by the numberal 71 in accordance with the present invention. Accordingly, tool 70 includes a body 72 having a grip portion 73 at one end, and a generally cylindrical portion 74 at its opposite end housing a conventional fastener driving assembly for driving a fastener such as clip member 18 through a driveway 75. Driveway 75 is formed in the head of tool 70 between abutting surfaces of a driver guide assembly 76 and a staple guide assembly 77 which in turn is mounted to the forward end of a fastener magazine 78 which in turn defines a longitudinal dimension for tool 70. Magazine 78 functions in the conventional manner to hold and sequentially feed a fastener to driveway 75 by means of a typical spring and pusher assembly (not shown) therein. A trigger 79 functions to actuate the drive assembly within portion 74 in the typical manner.

Figure 6:
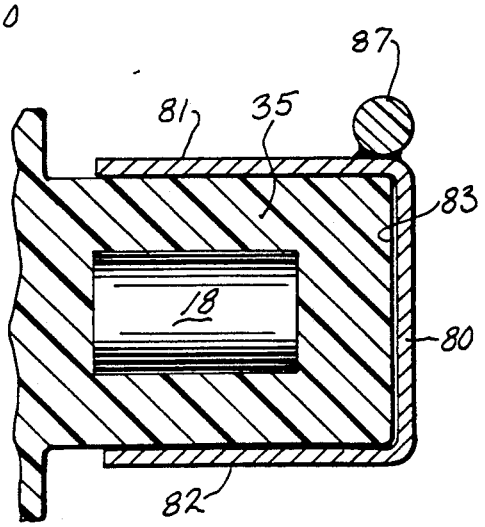
FIG. 6 is a cross sectional view taken along the plane of the line 6–6 in FIG. 5.

Tool 70 also includes a means for properly positioning the driveway 75 with respect to slots 41, 42 in ears 35, 36 respectively (FIG. 4). This positioning means includes a U-shaped plate member shown best in FIGS. 4 and 6 having a web portion 80 and a pair of opposite spaced apart leg portions 81, 82 defining a bracket receiving opening 83 therebetween. Opening 83 has a lower end and an upper end communicating with the discharge end of the driveway 75. As shown best in FIG. 6, the distance between leg portions 81 and 82 is slightly greater than the width of ears 35, 36 so that when leg portions 81, 82 are adjacent the sides of ears 35, 36 and web portion 80 abuts against the outer ends of ears 35, 36, as shown in FIG. 6, driveway 75 is aligned with slots 41 and 42 to properly position driveway 75 with respect thereto. As shown best in FIG. 4, each leg portion 81, 82 includes a recess 85, 86, respectively, which receives cable 12 when leg portions 81, 82 are positioned about ears 35, 36. Thus, recesses 85, 86 also aid in holding cable 12 at the appropriate position with respect to slots 41, 42 in ears 35, 36. As shown best in FIG. 3, support assembly 71 is mounted on fastener guide assembly 77 by means of post 87.

In FIG. 4, support assembly 71 also includes a means for supporting lower ear 36 during a fastener driving operation. This support means comprises a flat plate member 84 connected to the lower ends of web portion 80 and leg portions 81, 82, as shown best in FIG. 5. Plate member 84 extends across the lower end of bracket receiving opening 83 and when properly positioned, its inner face abuts against the lower face of ear 36 so as to support ear 36 when clip member 18 is driven into slots 41, 42. Plate member 84 thus prevents excessive downward movement or flexing of ear 36 in order to maintain the integrity of the seal along parting line 39. Plate member 84 also prevents ear 36 from possibly cracking or breaking during the fastener driving operation.

A support assembly for a fastener driving tool has been illustrated and described herein. Various modifications and/or substitutions of the specific components described herein may be made without departing from the scope of the present invention.

Various modes of carrying out the invention are contemplated as being within the scope of the following claims particularly pointing out and distinctly claiming the subject matter regarded as the invention.

I claim:

1. In a tool for applying a fastener to a mounting bracket including upper and lower spaced apart ears having aligned fastener-receiving openings formed therethrough, said tool including a housing having a manual grip portion, fastener driving means in said housing for driving a fastener through a driveway, fastener guide means aligned with said fastener driving means having said driveway therein with an upper receiving end and a lower discharge end, and a fastener magazine defining a longitudinal axis for holdng and sequentially feeding fasteners to said fastener guide means, the improvement comprising:

positioning means on said fastener guide means including longitudinal alignment means for longitudinally aligning said driveway relative to the fastener receivng openings in the mounting bracket, and lateral alignment means for laterally aligning said driveway relative to the fastener-receiving openings in the mounting bracket; and support means on said fastener guide means for supporting the lower ear of said bracket during a fastener driving operation.

2. The tool of claim 1 wherein said positioning means comprises a U-shaped plate member having a web portion and a pair of opposite spaced apart leg portions defining a bracket receiving opening having a lower end and an upper end communicating with the discharge end of said driveway.

3. The tool of claim 2 wherein said longitudinal alignment means comprises said web portion.

4. The tool of claim 2 wherein said lateral alignment means comprises said leg portions.

5. The tool of claim 2 wherein said support means comprises a flat plate member connected to said U-shaped plate member and extending across the lower and thereof.

* * * * *

UNITED STATES PATENT AND TRADEMARK OFFICE

CERTIFICATE OF CORRECTION

PATENT NO. : 5,007,573

DATED : Apr. 16, 1991

INVENTOR(S) : ARVO UUSKALLIO

It is certified that error appears in the above-identified patent and that said Letters Patent is hereby corrected as shown below:

Claim 5, column 6, line 52, delete "and" and substitute therefor ---end---.

Signed and Sealed this

Twenty-second Day of September, 1992

*Attest:*

DOUGLAS B. COMER

*Attesting Officer*

*Acting Commissioner of Patents and Trademarks*